US009921549B2

(12) United States Patent
Bolzt

(10) Patent No.: US 9,921,549 B2
(45) Date of Patent: Mar. 20, 2018

(54) DEVICE FOR ASSEMBLING A CASING RING IN A WATCH CASE MIDDLE

(71) Applicant: The Swatch Group Research and Development Ltd, Marin (CH)

(72) Inventor: Sebastien Bolzt, Bienne (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/726,845

(22) Filed: Jun. 1, 2015

(65) Prior Publication Data

US 2015/0346692 A1 Dec. 3, 2015

(30) Foreign Application Priority Data

Jun. 3, 2014 (EP) ..... 14170867

(51) Int. Cl.
*G04B 37/00* (2006.01)
*G04B 37/12* (2006.01)
*G04B 37/04* (2006.01)

(52) U.S. Cl.
CPC ..... *G04B 37/0008* (2013.01); *G04B 37/00* (2013.01); *G04B 37/0033* (2013.01);
(Continued)

(58) Field of Classification Search
CPC ..... G04B 19/14; G04B 37/00; G04B 37/04; G04B 37/0008; G04B 37/0033; G04B 37/0041; G04B 37/12
(Continued)

(56) References Cited

U.S. PATENT DOCUMENTS 5,511,885 A * 4/1996 Coleman ..... F16C 33/08 384/296
2003/0016591 A1* 1/2003 Meyrat ..... G04B 37/0033 368/309

(Continued)

FOREIGN PATENT DOCUMENTS

CH 290651 5/1953
CH 333999 A * 11/1958 ..... G04B 37/05

(Continued)

OTHER PUBLICATIONS

English Translation of Lipe, EP 1312989, electronically translated Mar. 28, 2016.*

(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A device is provided for assembling a casing ring in a watch case middle including a bearing surface on an inner wall thereof, the casing ring including a housing opening in a lateral face of the casing ring, and in an upper or lower face of the casing ring. The device includes a locking part pivotable about a vertical axis of rotation passing through the upper or lower opening from a first position, in which the locking part is housed in the housing, to a second position, in which the locking part protrudes and abuts against the bearing surface of the inner wall of the case middle so as to hold the casing ring in the case middle. The locking part is snap-fitted in the housing and is pivotable about the vertical axis of rotation. A timepiece and a watch case fitted with the assembly device are also provided.

15 Claims, 4 Drawing Sheets

(52) U.S. Cl.
CPC ..... *G04B 37/0041* (2013.01); *G04B 37/04* (2013.01); *G04B 37/12* (2013.01); *Y10T 29/53796* (2015.01)

(58) Field of Classification Search
USPC ..... 368/297, 299, 300
See application file for complete search history.

(56) References Cited

U.S. PATENT DOCUMENTS

| | | | | |
|---|---|---|---|---|
| 2008/0225650 | A1* | 9/2008 | Muller | G04B 37/00 368/310 |
| 2009/0245032 | A1* | 10/2009 | Bonnet | G04B 37/0008 368/297 |
| 2012/0120779 | A1* | 5/2012 | Altenhoven | G04B 37/05 368/300 |
| 2014/0169143 | A1* | 6/2014 | Kobayashi | G04B 37/05 368/276 |
| 2014/0313870 | A1* | 10/2014 | Bolzt | G04B 39/02 368/294 |

FOREIGN PATENT DOCUMENTS

| | | | | |
|---|---|---|---|---|
| CH | 1641764 | A4 * | 11/1967 | G04B 37/057 |
| CH | 613590 | A * | 10/1979 | G04B 37/05 |
| CH | 613591 | A * | 10/1979 | G04B 37/05 |
| CH | 697211 | A5 * | 6/2008 | G04B 19/14 |
| DE | 2223007 | A1 * | 12/1972 | G04B 37/0008 |
| EP | 0716360 | A1 * | 6/1996 | G04B 37/05 |
| EP | 1 312 989 | A1 | 5/2003 | |
| EP | 1450218 | A1 * | 8/2004 | G04B 29/04 |

OTHER PUBLICATIONS

English Translation of Ebosa, CH290651, electronically translated Apr. 1, 2016.*

Snap-Fit, Wikipedia, full document, retreived on Sep. 8, 2016 from <https://en.wikipedia.org/wiki/Snap-fit>.*

Finger, Firma, English Translation of CH 613591, originally published on Oct. 15, 1979, full document.*

Taubert, Richemont, English Translation of CH 333999, originally published Nov. 15, 1958, full document.*

Coeudevez, Joel, English Translation of EP 1450218, originally published Aug. 25, 2004, full document.*

European Search Report dated Mar. 27, 2015 in European Application 14170867.7 filed on Jun. 3, 2014 ( with English translation).

* cited by examiner

DEVICE FOR ASSEMBLING A CASING RING IN A WATCH CASE MIDDLE

This application claims priority from European Patent Application No. 14170867.7 filed Jun. 3, 2014 the entire disclosure of which is incorporated herein by reference.

FIELD OF THE INVENTION

The present invention concerns a device for assembling a casing ring in a watch case middle.

BACKGROUND OF THE INVENTION

The casing ring is usually secured to the watch case by means of clamps and/or screws. However, such assembly methods have a certain number of drawbacks. Indeed, the thickness of the clamps and screw heads may prove inconvenient and result in excessive thickness of the parts. Further, the size of the screws requires a specific tool and a certain amount of experience for the assembly operation.

Thus, it has already been proposed to assembly a casing ring in a watch case without the necessity of using additional means such as screws or clamps.

EP Patent No 1312989 discloses such a device for assembling a casing ring to a watch case. More specifically, this document discloses a watch case including truncated housings machined in the inner wall of the watch case and a casing ring including at least two truncated chambers open on the rear and lateral faces of the ring. The truncated chambers are capable of receiving locking parts able to be moved in rotation from a free position, in which they are completely inside the chambers, to a locking position, in which they are partially housed in the chambers and partially inside corresponding housings in the case.

The assembly device described above has several drawbacks. First, it will be mentioned that the locking parts are removable, which involves a meticulous assembly of the casing ring once the locking parts are in place, since the casing ring must remain flat to avoid dislodging one or more of the locking parts. Next, it will be mentioned that the locking parts are of small size, which means they are difficult to handle during assembly of the watch. Finally, it will be observed that both the watch case and the casing ring require complex machining operations due to the shape of the locking parts.

SUMMARY OF THE INVENTION

It is an object of the invention to overcome the various drawbacks of these known techniques.

More specifically, it is an object of the invention to provide an assembly device which does not require the operator to perform complex operations during the assembly of the watch.

It is also an object of the invention, at least in a particular embodiment, to provide a device that is simple to implement and inexpensive.

These objects, in addition to others which will appear more clearly below, are achieved by the invention with the aid of a device for assembling a casing ring in a watch case middle including, on its inner wall, at least one bearing surface, said casing ring including at least one housing opening, on the one hand, in the lateral face of said casing ring through a lateral opening, and on the other hand, in the upper or lower face of the casing ring through an upper or lower opening, said device including at least one locking part, of complementary shape to said housing, capable of pivoting about a vertical axis of rotation passing through said upper or lower opening from a first position, called the retracted position, in which said locking part is at least partially housed in said housing, to a second position, called the locking position, in which said locking part protrudes and abuts against said bearing surface of the inner wall of said case middle so as to hold said casing ring in said case middle.

According to the invention, said at least one locking part is snap-fitted in said at least one housing and pivots about said vertical axis of rotation.

According to optional features of the invention, taken alone or in combination:

- said locking part includes a pin integral with the locking part;
- said housing includes a snap-fit opening capable of cooperating with said pin of said locking part to snap-fit said locking part laterally through the lateral opening;
- said snap-fit opening includes, in succession, an entrance having a bottleneck forming a retaining portion, and a receiving area configured to receive said pin in which said pin is retained and can pivot;
- said pin of said locking part has a slot capable of cooperating with a screwing tool;
- said snap-fit opening, said pin and said upper or lower opening are arranged coaxially along said vertical axis of rotation so that the slot of said pin is accessible through said upper or lower opening;
- said locking part has an upper face and a lower face parallel to a plane orthogonal to the vertical axis, a rear face and a front face perpendicular to the upper and lower faces, and two lateral faces perpendicular to the upper and lower faces and to the front and rear faces, said locking part including a groove opening onto its front and lateral faces, the groove being configured to cooperate with said bearing surface of said case middle;
- said groove extends along the front face between the upper and lower faces, and has a U-shaped profile; said casing ring includes several housings and locking parts angularly distributed around said casing ring to ensure axial and radial positioning relative to the case middle;
- said casing ring and said locking parts are made of a plastic material.

The invention also concerns a watch case fitted with a device according to the invention, and including a movement surmounted by a dial and mounted in the casing ring, which is in turn mounted in the case, a crystal fixed to a bezel, a case middle and a back cover, said case middle having a peripheral shoulder on its inner wall, and said shoulder being intended to cooperate with said locking parts.

The invention also concerns a timepiece fitted with an assembly device according to the invention.

Thus, by means of the various functional and structural aspects described above, the subject of the present invention can ensure the reliable and simple assembly of a casing ring to the watch case middle.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF PREFERRED EMBODIMENTS

Figure 1:
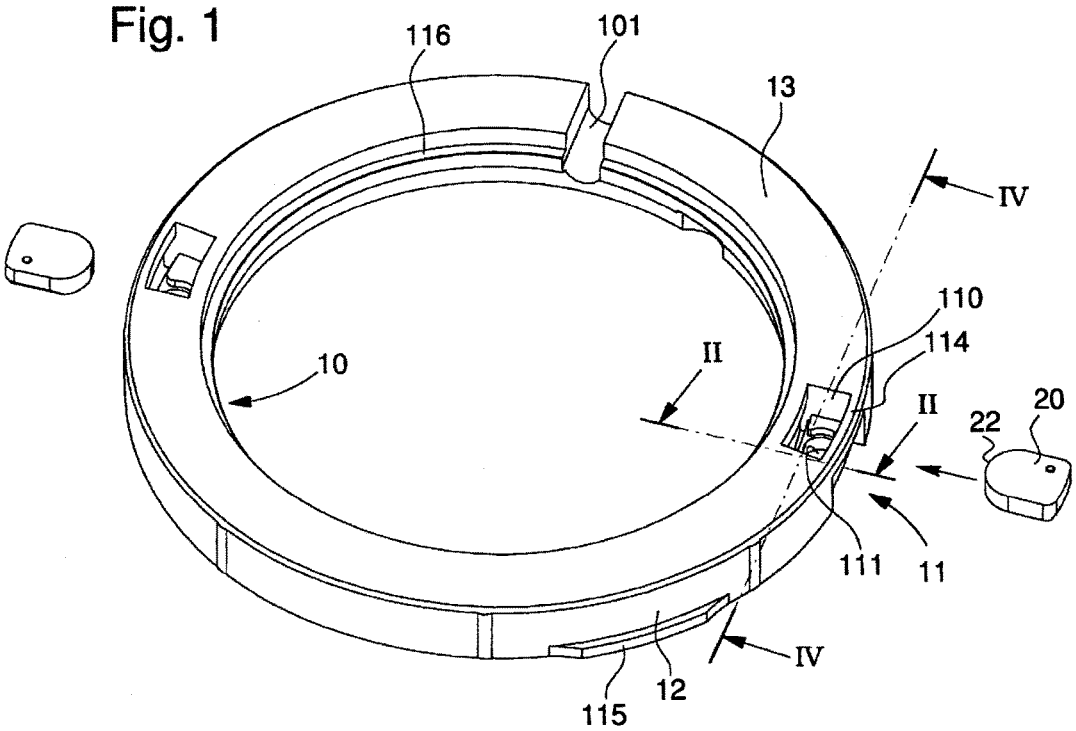
FIG. 1 is a perspective view of the assembly device according to the invention.

An assembly device 1 according to an example embodiment will now be described below with reference jointly to FIGS. 1, 2, 3A, 3B, 4A, 4B and 5.

As mentioned above, the general principle of the invention lies in the implementation of a device 1 for assembling a casing ring 10 in a watch case middle 30, watch case middle 30 including at least one bearing surface 31 on its inner wall, and casing ring 10 including at least one housing 11 opening, on the one hand, in the lateral face 12 of said casing ring 10 through a lateral opening 110, and on the other hand in the upper or lower face 13 of casing ring 10 through an upper or lower opening 111.

The device includes at least one locking part 20 of substantially parallelepiped and complementary shape to housing 11, configured to pivot about a vertical axis of rotation V passing through upper or lower opening 111 from a first position, called the retracted position, in which locking part 20 rests in housing 11, to a second position, called the locking position, in which locking part 20 protrudes and is engaged in recess 31 in the inner wall of case middle 30 so as to hold casing ring 10 in case middle 30.

Locking part 20 has an upper face and a lower face which are parallel to a plane P orthogonal to vertical axis V, the upper face facing upper opening 111 of casing ring 10, a rear face 22 and a front face which are perpendicular to the upper and lower faces, locking part 20 being inserted into housing 11 through rear face 22, and two lateral faces which are perpendicular to the upper and lower faces and to the front face and rear face 22. According to an alternative of the invention, not illustrated in the Figures, casing ring 10 has only one locking part 20 and implicitly only one housing 11, and a lug acting as a fixed locking part cooperating with watch case middle 30 in order to secure casing ring 10 on one side to case middle 30. The casing ring is then permanently secured to the case middle by moving locking part 20 into the locked position.

According to the invention, locking part 20 is intended to be snap-fitted laterally into a housing 11 of casing ring 10 through lateral opening 110.

The bearing surface or surfaces 31 formed on the inner wall of watch case middle 30 may, for example, take the form of a housing of rectangular or oblong shape, so that the shape of recesses 31 matches the shape of the portion of locking part 20 received in the corresponding recess 31.

It is also possible to envisage that the bearing surface 31 formed on the inner wall of case middle 31 takes the form of a tongue extending over all or part of the inner surface of watch case middle 30.

According to yet another embodiment, not shown, watch case middle 30 may include a peripheral or local shoulder, intended to act as bearing surface for locking parts 20.

Figure 4A:
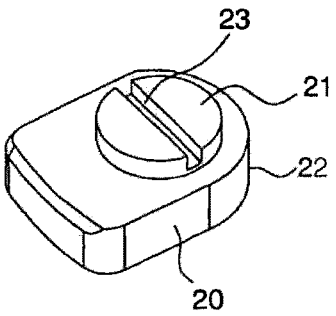
FIGS. 4A and 4B are respectively a perspective view of a locking part of an assembly device according to the invention, and a cross-sectional view along the line IV-IV of FIG. 1 of a housing of an assembly device according to the invention.

As can be observed in FIG. 4A, locking part 20 is of substantially rectangular shape, rear face 22 having rounded edges to facilitate its rotation inside housing 11 of casing ring 10.

Figure 6:
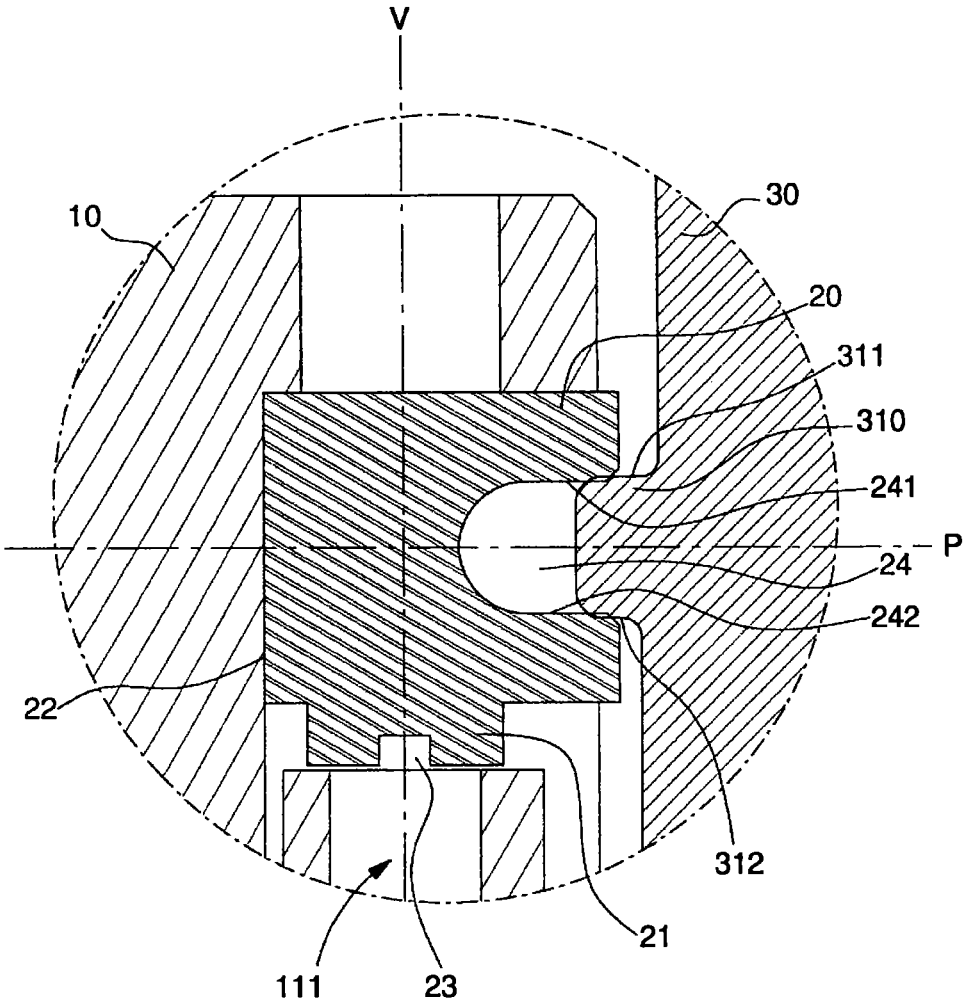
FIG. 6 is a vertical cross-sectional view along the axis V of a housing of an assembly device according to the invention.

According to a variant of the invention, illustrated in FIG. 6, locking part 20 includes a groove 24 opening on the front face and on each of the lateral faces of locking part 20. According to this variant, groove 24 extends in a plane P orthogonal to axis V, across the width of part 20 and has a U-shaped profile.

Groove 24 of locking part 20 is configured to cooperate with at least one rib 310 acting as bearing surface, the rib being formed on the inner wall of case middle 30 and having an upper surface 311 and a lower surface 312 extending perpendicularly to the inner wall of case middle 30.

In the locking position, upper wall 241 and lower wall 242 of groove 24 respectively bear on upper face 311 and lower face 312 of rib 310 of case middle 30. This arrangement makes it easy to lock and position casing ring 10 correctly in case middle 30.

The case middle may also, for example, have three ribs 310 angularly distributed over the inner wall of case middle 30, or alternatively a peripheral rib 310.

Advantageously, a pin 21 of cylindrical shape is disposed in proximity to rear face 22 and extends vertically from one of its large faces. The pin snap-fits into housing 11 at a snap-fit opening 113 of complementary shape to that of pin 21. Pin 21 also has a slot 23 on its upper face so as to allow insertion of a tool, such as a screwdriver, in order to rotate locking part 20. This slot 23 could be arranged on the large face opposite that carrying pin 21 so that slot 23 is accessible when casing ring 10 is mounted in case middle 30 from the back side of the case.

In this example, locking part 20 and pin 21 form a single element which may be made of plastic material, or even metallic material. It will be understood here that other materials could have been envisaged by those skilled in the art within the scope of the present invention.

As can be observed in FIG. 1, casing ring 10 includes a housing 11 machined by milling for example, in casing ring 10, housing 11 having a lateral opening 110 of rectangular shape on the lateral face 12 of the ring, and an upper opening 111 of circular shape on upper face 13 of the ring. Preferably, casing ring 10 includes at least two housings 11 and two corresponding locking parts 20, each of locking parts 20 cooperating with a respective pre-machined recess 31 in the inner wall of case middle 30. Depending on the direction of assembly of casing ring 10, a lower opening may be provided in place of upper opening 111.

When housing 11 is machined in casing ring 10, a bridge 114 is formed on the upper or lower face, so as to hold locking part 20 vertically in housing 11. Thus, during the change into the locking position, locking part 20 is held vertically in housing 11 and pin 21 cannot be dislodged from snap-fit opening 113.

Figure 5:
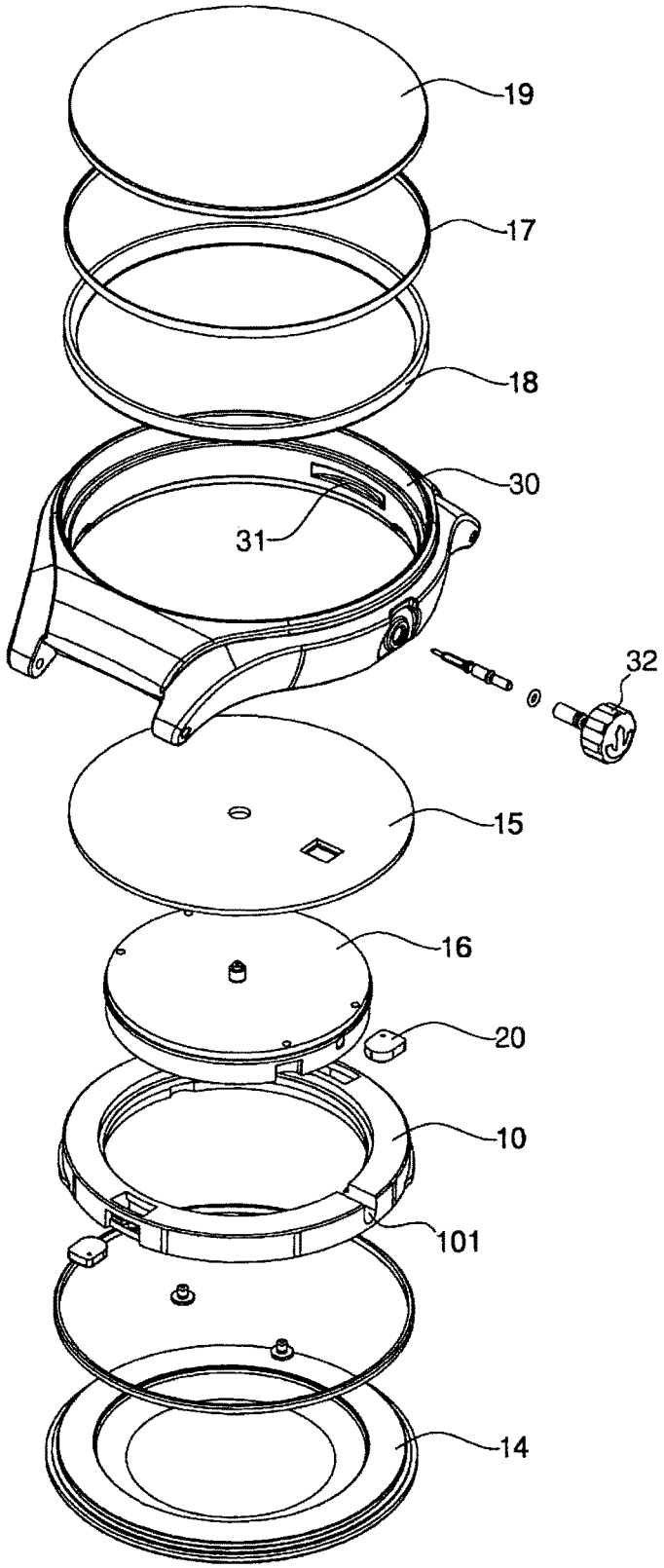
FIG. 5 is an exploded view of a watch case fitted with an assembly device according to the invention.

A hollow 101, visible in FIG. 5, is also formed in casing ring 10, in order to introduce the crown into movement 16 during assembly of the watch.

Casing ring 10 also includes at least one positioning lug 115, on the base thereof, intended to cooperate with case middle 30 so as to properly position casing ring 10 in case middle 30. According to another embodiment, not illustrated in the Figures, positioning lug 115 extends over the periphery of casing ring 10.

In the example embodiment illustrated in the Figures, upper opening 111 of housing 11 is positioned slightly off-centre towards one of the edges of housing 11.

According to another embodiment of the invention, casing ring 10 includes several housings 11 and locking parts 20, for example three, and case middle 30 has a number of bearing surfaces 31 matching the number of locking parts 20 so as to hold casing ring 10 securely.

According to the preceding embodiment, housings 11 and locking parts 20 are angularly distributed around casing ring 10 to ensure the proper axial and radial positioning of casing ring 10 relative to case middle 30.

According to a preferred embodiment of the invention, casing ring 10 may be made of plastic material, for example by injection moulding, so as to reduce manufacturing costs.

Figure 4B:
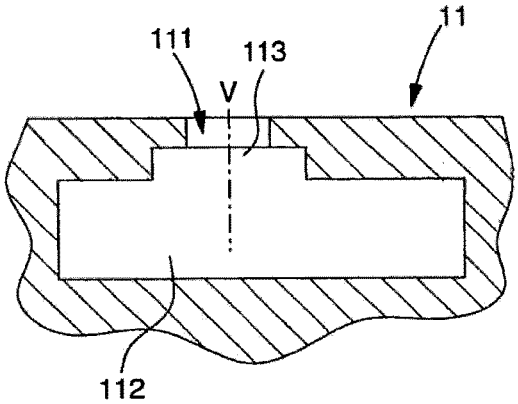

At the front, as illustrated in FIG. 4B, housing 11 has a first space 112 intended to receive locking part 20, the first space 112 having slightly larger dimensions than those of the body of locking part 20 so that locking part 20 can pivot without friction in housing 11.

Housing 11 includes a second space, called the snap-fit opening 113, intended to receive locking part pin 21. Snap-fit opening 113 has an entrance forming a bottleneck of slightly smaller dimension than that of the diameter of pin 21, so that pin 21 is forced inside a receiving area adjoining the entrance, the receiving area being of circular shape and slightly larger diameter than that of pin 21 in order to hold locking part 20 in housing 11.

Advantageously, snap-fit opening 113 and more precisely the receiving area of snap-fit opening 113 is disposed coaxially to circular opening 111, so that slot 23 of pin 21 is accessible through circular opening 111, circular opening 111 having a slightly smaller diameter than the diameter of snap-fit opening 113.

Once snap-fitted, locking part 20 can pivot from a first position, called the retracted position, in which locking part 20 rests in housing 11, to a second position, called the locking position, in which locking part 20 protrudes and cooperates with a bearing surface 31 of the inner wall of case middle 30 in order to maintain casing ring 10 in case middle 30.

Figure 3A:
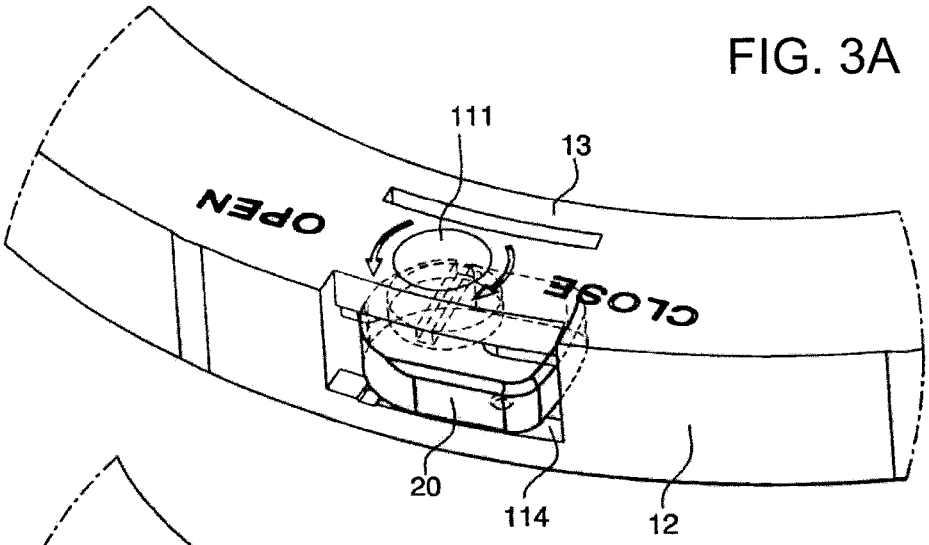
FIGS. 3A and 3B are respectively perspective views of an assembly device according to the invention in the retracted position and in the locking position.
Figure 3B:
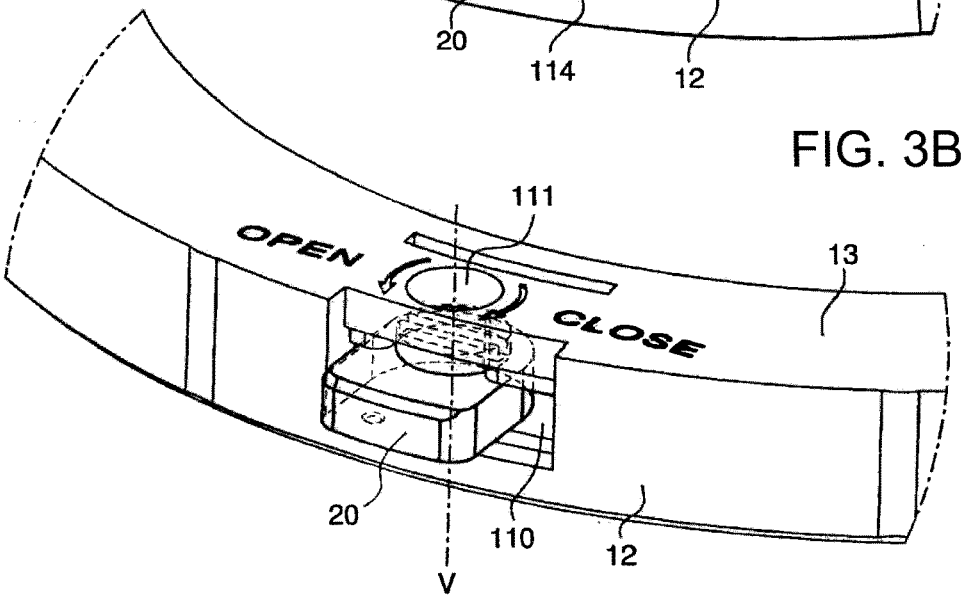

As can be observed in FIGS. 3A and 3B, the length of housing 11 is slightly greater than the length of locking part 20, and the length of locking part 20 is greater than the depth of housing 11, so that a portion of locking part 20 protrudes and can cooperate with a bearing surface of the watch case middle.

Figure 2:
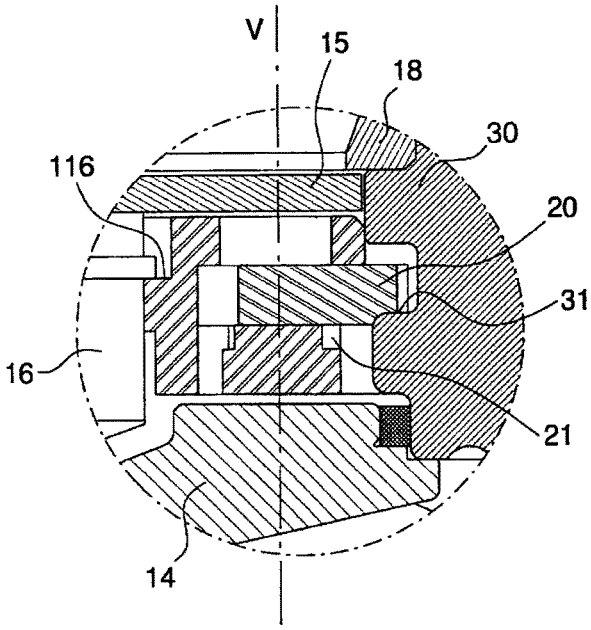
FIG. 2 is a cross-section along the line II-II of FIG. 1 of the assembly device according to the invention in a locking position.

As shown in FIG. 2, casing ring 10 is provided with previously snap-fitted locking parts 20, these locking parts 20 making it possible to position casing ring 10 relative to case 30 by lodging in a recess 31 of case middle 30.

FIG. 5 illustrates a watch case including a case middle 30, a back cover 14 removably assembled to case middle 30, casing ring 10 of the invention being capable of insertion into case middle 30. Casing ring 10 serves to maintain watch movement 16, and is held inside case middle 30 by means of locking parts 20.

Movement 16 is slid from above, in the illustrated example, into casing ring 10 until it comes into contact with a shoulder 116 of the inner surface of casing ring 10. The assembly comprising movement 16-casing ring 10 is slid into case middle 30 until it abuts dial 15, or back cover 14 depending on the direction of assembly. Advantageously according to the invention, the locking parts 20 present on casing ring 10 permit casing ring 10 to be secured to case middle 30.

As can be observed, the watch includes a crown 32, which is mounted on movement 16 passing in succession through the hole in case middle 30, the hollow 101 of casing ring 10 and the hole in movement 16, in order to be secured thereto.

The watch case also includes a flange 18, which is mounted between dial 15 and crystal 19 and bears on case middle 30 so as to partially overlap the periphery of dial 15 and includes a gasket 17 securing crystal 19 to case middle 30, and which thus closes the upper part of the watch case.

The lower part of the watch case is closed by securing back cover 14 so that the movement 16-casing ring 10 assembly presses against case middle 30.

The assembly of casing ring 10 on watch case 30 is accomplished as follows.

First, the operator snap-fits locking parts 20 into each of housings 11 of the casing ring by forcibly inserting pin 21 in each of snap-fit openings 113, so that the slot 23 present on pin 21 is visible through circular opening 111. Once the snap-fit is accomplished, the operator positions locking parts 20 in the retracted position either manually or by means of a screwdriver.

The operator then introduces casing ring 10, fitted with locking parts 20, into watch case 30 until the lower or upper face thereof abuts on dial 15 or back cover 14 of case middle 30, depending on the direction of assembly. Next, with the aid of a screwdriver, the operator rotates locking parts 20, via pin 21, by a quarter turn so as to move locking parts 20 into the locking position. Thus, one portion of each of locking parts 20 cooperates with a bearing surface 31 of watch case 30, which has the effect of securing casing ring 10 to case middle 30. The watch movement 16 may be disposed in casing ring 10 before or after casing ring 10 is secured to case middle 30, depending on the selected order of assembly.

According to one embodiment of the invention, illustrated in FIGS. 3A and 3B, casing ring 10 may have markings on upper face 13, such as "open" and "close" accompanied by an arrow indicating the direction of rotation for example, intended to indicate to the operator the direction in which to pivot locking part 20 to lock or unlock casing ring 10 to or from case middle 30.

The invention also concerns a timepiece fitted with an assembly device 1 as described above; the timepiece may be either a mechanical watch or an electronic watch.

As a result of these different aspects of the invention, there is provided a device for assembling a casing ring in a watch case middle that is easy for an operator to handle and to install, and which does not require the use of screws or clamps.

Naturally, other embodiments could have been envisaged by those skilled in the art without thereby departing from the scope of the invention defined by the claims below.

LIST OF PARTS

1. Assembly device
10. Casing ring
101. Casing ring hollow
11. Housing
110. Lateral opening
111. Upper opening
112. First space of the housing
113. Snap-fit opening
114. Holding bridge

115. Positioning lug
116. Casing ring shoulder
12. Lateral face
13. Upper face
14. Back cover
15. Dial
16. Movement
17. Gasket
18. Flange
19. Crystal
20. Locking part
21. Pin
22. Rear face of the locking part
23. Slot
24. Groove
241. Upper wall of the groove
242. Lower wall of the groove
30. Case middle
31. Bearing surface
310. Rib
311. Upper face of the rib
312. Lower face of the rib
32. Crown
V Vertical axis of rotation
P Plane orthogonal to the vertical axis

What is claimed is:

1. A device for assembling a casing ring in a watch case middle including, on an inner wall thereof, at least one bearing surface, said casing ring including at least one housing opening in a lateral face of said casing ring through a lateral opening, and in an upper or lower face of the casing ring through an upper or lower opening, said device comprising:

at least one locking part, of complementary shape to said housing, that is pivotable about a vertical axis of rotation passing through said upper or lower opening from a first position, which is a retracted position, in which said locking part is at least partially housed in said housing, to a second position, which is a locking position, in which said locking part protrudes and abuts against the at least one bearing surface of the inner wall of said case middle so as to hold said casing ring in said case middle, wherein a pin of said at least one locking part is snap-fitted in said at least one housing, and the at least one locking part is pivotable about said vertical axis of rotation without frictionally contacting the at least one housing.

2. The assembly device according to claim 1, wherein said locking part includes the pin being integral with the locking part.

3. The assembly device according to claim 2, wherein said pin of said locking part has a slot that is cooperable with a screwing tool.

4. The assembly device according to claim 3, wherein said snap-fit opening, said pin and said upper or lower opening are arranged coaxially along said vertical axis of rotation so that the slot of said pin is accessible through said upper or lower opening.

5. The assembly device according to claim 1, wherein said housing includes a snap-fit opening that is cooperable with the pin of said locking part so as to snap-fit said locking part laterally through the lateral opening.

6. The assembly device according to claim 5, wherein said snap-fit opening includes, in succession, an entrance having a bottleneck forming a retaining portion, and a receiving area configured to receive said pin in which said pin is retained and pivotable.

7. The assembly device according to claim 1, wherein said locking part has an upper face and a lower face parallel to a plane orthogonal to the vertical axis, a rear face and a front face perpendicular to the upper and lower faces of the locking part, and two lateral faces perpendicular to the upper and lower faces of the locking part and to the front and rear faces, said locking part including a groove opening on the front and lateral faces thereof, the groove being configured to cooperate with said at least one bearing surface of said case middle.

8. The assembly device according to claim 7, wherein said groove extends along the front face between the upper and lower faces of the locking part, and has a U-shaped profile.

9. The assembly device according to claim 1, wherein said casing ring includes several housings and locking parts angularly distributed around said casing ring to ensure axial and radial positioning relative to the case middle.

10. The assembly device according to claim 1, wherein said casing ring and said at least one locking part are made of plastic material.

11. The assembly device according to claim 1, wherein the at least one locking part is disposed so that in the locking position, the locking part protrudes from a radial outer periphery of the casing ring.

12. The assembly device according to claim 1, wherein the locking part includes a substantially rectangular shape including at least one rounded edge.

13. The assembly device according to claim 1, wherein a face of the casing ring includes at least one marking indicating a direction of rotation to place the locking part in the retracted position or the locking position.

14. A watch case fitted with a device for assembling a casing ring in a watch case middle, comprising:

the case middle including, on an inner wall thereof, at least one bearing surface, said casing ring including at least one housing opening in a lateral face of said casing ring through a lateral opening, and in an upper or lower face of the casing ring through an upper or lower opening, said device including at least one locking part, of complementary shape to said housing, that is pivotable about a vertical axis of rotation passing through said upper or lower opening from a first position, which is a retracted position, in which said locking part is at least partially housed in said housing, to a second position, which is a locking position, in which said locking part protrudes and abuts against the at least one bearing surface of the inner wall of said case middle so as to hold said casing ring in said case middle, wherein a pin of said at least one locking part is snap-fitted in said at least one housing, and the at least one locking part is pivotable about said vertical axis of rotation without frictionally contacting the at least one housing, said watch case further including a movement surmounted by a dial and mounted in said casing ring which is in turn mounted in said case middle, a crystal integral with a gasket, and a back cover, said case middle having a peripheral shoulder on the inner wall thereof, said shoulder being cooperable with said at least one locking part.

15. A timepiece comprising:

a watch case middle fitted with an assembly device to assemble a casing ring in said watch case middle including, on an inner wall thereof, at least one bearing surface, said casing ring including at least one housing opening in a lateral face of said casing ring through a lateral opening, and in an upper or lower face of the casing ring through an upper or lower opening, said device including at least one locking part, of complementary shape to said housing, that is pivotable about a vertical axis of rotation passing through said upper or lower opening from a first position, which is a retracted position, in which said locking part is at least partially housed in said housing, to a second position, which is a locking position, in which said locking part protrudes and abuts against the at least one bearing surface of the inner wall of said case middle so as to hold said casing ring in said case middle, wherein a pin of said at least one locking part is snap-fitted in said at least one housing, and the at least one locking part is pivotable about said vertical axis of rotation without frictionally contacting the at least one housing, said timepiece further including a movement surmounted by a dial and mounted in said casing ring which is in turn mounted in said case middle, a crystal integral with a gasket, and a back cover, said case middle having a peripheral shoulder on the inner wall thereof, said shoulder being cooperable with said at least one locking part.

* * * * *